US010184705B2

(12) United States Patent
Dal Pra'

(10) Patent No.: US 10,184,705 B2
(45) Date of Patent: Jan. 22, 2019

(54) ACTUATION METHOD OF A REFRIGERATING MACHINE PROVIDED WITH AN ECONOMIZER APPARATUS

(71) Applicant: CAREL INDUSTRIES S.P.A., Brugine (PD) (IT)

(72) Inventor: Giuseppe Dal Pra', Brugine (IT)

(73) Assignee: CAREL INDUSTRIES S.P.A., Brugine (PD) (IT)

( * ) Notice: Subject to any disclaimer, the term of this patent is extended or adjusted under 35 U.S.C. 154(b) by 592 days.

(21) Appl. No.: 14/517,838

(22) Filed: Oct. 18, 2014

(65) Prior Publication Data

US 2015/0107284 A1 Apr. 23, 2015

(30) Foreign Application Priority Data

Oct. 18, 2013 (IT) ..... VI2013A0257

(51) Int. Cl.
*F25B 49/02* (2006.01)
*F25B 1/06* (2006.01)

(52) U.S. Cl.
CPC ..... *F25B 49/02* (2013.01); *F25B 2400/13* (2013.01); *F25B 2600/2509* (2013.01)

(58) Field of Classification Search
CPC ..... F25B 49/02; F25B 2400/13; F25B 2600/2509

(Continued)

(56) References Cited

U.S. PATENT DOCUMENTS 4,014,182 A * 3/1977 Granryd ..... F25B 1/00 62/117
4,193,781 A * 3/1980 Vogel ..... F25B 49/02 236/1 E (Continued)

FOREIGN PATENT DOCUMENTS

CN 102066851 A 5/2011
CN 102648383 A 8/2012

(Continued)

OTHER PUBLICATIONS

English Abstract of CN102648383A dated Aug. 22, 2012.
English Abstract of CN102066851A dated May 18, 2011.

*Primary Examiner* — Len Tran
*Assistant Examiner* — Kirstin Oswald
(74) *Attorney, Agent, or Firm* — Hedman & Costigan, P.C.; James V. Costigan; Kathleen A. Costigan

(57) ABSTRACT

An actuation method of a refrigerating machine (10) provided with an economizer apparatus (16) and including an auxiliary laminating member (18) having the opening adjustable for modulating a tapping flow rate of refrigerating fluid flowing through the economizer apparatus (16) including a checking phase of the value of the condensing temperature (Tc) compared to a first threshold value (Tc-max);

a first adjustment phase of the opening of the auxiliary laminating member (18) in order to keep the temperature of said tapping flow rate at the entrance of the compressor (15) of the refrigerating machine (10) substantially equal to a predetermined overheating value, if the condensing temperature (Tc) is lower than the first threshold value (Tc-max);

(Continued)

a second adjustment phase of the opening of the auxiliary laminating member (18) depending on the value of the condensing temperature (Tc).

9 Claims, 2 Drawing Sheets

(58) Field of Classification Search
USPC ..... 62/115
See application file for complete search history.

(56) References Cited

U.S. PATENT DOCUMENTS 6,571,576 B1 * 6/2003 Lifson ..... F04C 29/042 62/196.1
6,955,059 B2 * 10/2005 Lifson ..... F25B 41/04 62/197
2006/0123840 A1 * 6/2006 Lifson ..... F25B 40/00 62/513
2009/0171512 A1 * 7/2009 Duncan ..... F24F 5/0035 700/300
2010/0101248 A1 * 4/2010 Lifson ..... F25B 49/02 62/115
2010/0132399 A1 * 6/2010 Mitra ..... F25B 9/008 62/498
2010/0281894 A1 * 11/2010 Huff ..... F25B 9/008 62/115
2011/0174014 A1 * 7/2011 Scarcella ..... F25B 1/10 62/510
2012/0011866 A1 * 1/2012 Scarcella ..... F25B 1/10 62/79

FOREIGN PATENT DOCUMENTS

EP 0685692 A2 12/1995
EP 1970653 A1 9/2008
EP 2538159 A2 12/2012
JP 06-265232 A 9/1994
WO WO 2008143611 A1 * 11/2008 ..... F25B 1/10

* cited by examiner

ACTUATION METHOD OF A REFRIGERATING MACHINE PROVIDED WITH AN ECONOMIZER APPARATUS

The present invention regards an actuation method of a refrigerating machine provided with an economizer apparatus.

Particularly, the present invention refers to an actuation method of a refrigerating machine provided with a screw compressor or the like which provides the introduction, at an intermediate compression stage, of the fraction of refrigerant fluid employed in the economizer.

Therefore the present invention takes its place in the field of the refrigerating machines.

Nowadays, it is known to equip refrigerating machines with an economizer apparatus.

Such apparatus provides to tap, from the overall flow rate of refrigerant fluid exiting from the condenser, a tapping flow rate, to operate an expansion of the tapping flow rate in an auxiliary laminating member and to operate a thermal exchange between such tapping flow rate and the main flow rate, which consists in the overall flow rate subtracted of the tapping flow rate.

Such thermal exchange is carried out upstream of the main laminating member of the refrigerating machine and it has the effect of obtaining a subcooling of the main flow rate.

The tapping flow rate is introduced in the compressor, downstream of the thermal exchange with the main flow rate, at an intermediate stage of the latter. Structurally, traditional apparatuses include:

- a duct, for the tapping flow rate, which is connected to the main circuit of the refrigerating machine downstream of the condenser;
- an auxiliary laminating member placed along the duct adapted to laminate the tapping flow rate and to modulate it;
- a heat exchanger placed along the duct downstream of the auxiliary laminating member and coupleable to the circuit of the refrigerating machine for exchanging heat with the refrigerating fluid of such circuit.

A control device of the refrigerating machine controls the auxiliary laminating member in order to keep the overheating of the tapping flow rate inside the compressor at a predefined value which, just for example, can be equal to 10 K.

Furthermore, nowadays these traditional refrigerating machines are provided with detecting means of the condensing temperature which, as it is known, is directly linked to the compressor delivery pressure.

In the present document, the condensing temperature is to be meant as the saturation temperature of the refrigerating fluid at the compressor delivery and the evaporation temperature is to be meant the saturation temperature of the refrigerating fluid at the compressor suction.

The control device of these traditional machines is designed to control the closing of the auxiliary laminating member when the condensing temperature overcomes a safety value which is predefined and indicated by the compressor manufacturer.

In practice as the traditional actuation method of the today known refrigerating machines, described above, it provides two phases:

- a first phase which is carried out if the condensing temperature is lower than the safety value, which consists in modulating the opening of the auxiliary laminating member depending on the above mentioned predefined overheating;

- a second phase which is carried out when the condensing temperature reaches the safety temperature, which consists in closing the auxiliary laminating member itself, so deactivating the economizer apparatus.

The action of the economizer apparatus increases the coefficient of performance (COP) and the energy efficiency ratio (EER) of the refrigerating machine, therefore it is desirable that it remains operative as much as possible during the refrigerating machine operation.

Nevertheless, for guaranteeing the compressor functionality, in the traditional refrigerating machines, the economizer apparatus is deactivated after an increase of the condensing temperature over the value of the safety temperature, which for some kind of machine can be for example equivalent to 60° C.

Such safety value is equivalent to the maximum condensing temperature at which the compressor motor is able to supply the required power depending on the evaporation temperature of the refrigerating machine that includes it.

Such value of the safety temperature is indicated by the compressor manufacturer.

So, when the operating conditions of a refrigerating machine are such as having a condensing temperature varying near the value of the safety temperature, the control device tends to activate and deactivate in sequence the economizer apparatus, i.e. by deactivating it when the safety temperature is reached, and by activating it as soon as possible when the condensing temperature goes down under the value of the condensing temperature.

The intermittent working deriving from such sequence of activations and deactivations causes a fatigue of the components which tend therefore to loose efficiency and lifetime.

In general, therefore, nowadays some admissible operating conditions are defined in which the economizer apparatus is activated and out of those the latter is deactivated.

These admissible operating conditions are generally defined by a range of condensing temperatures and by a range of evaporation temperatures, outside such ranges the economizer apparatus is deactivated.

For example it is illustrated in the enclosed FIG. 1, defined by a dotted line, the field of the admissible operating conditions for a traditional machine, indicated by reference A, where such admissible operating conditions are expressed depending on the condensing temperature Tc and of the evaporation temperature Te and, briefly, are defined by admissible ranges for such temperatures Tc and Te where these must be included respectively in a range [Tc-min,Tc-max] and in a range [Te-min,Te-max].

By Tc-max it has been designated the safety temperature which has been discussed more above.

In general, therefore, the operating method of these traditional refrigerating machines provides:

- comparing the operating conditions of the refrigerating machine with the admissible operating conditions;
- deactivating the economizer apparatus if the operating conditions do not satisfy the admissible operating conditions;
- activating the economizer apparatus if the operating conditions satisfy the admissible operating conditions.

Therefore, the traditional refrigerating machines have the drawback of presenting, when they do not work according to said admissible operating conditions, a reduction of the power released, which can be also of 15%-20%.

The patent documents JP-H06265232, EP2538159, EP1970653 and EP685692 describe traditional refrigerating machines.

These refrigerating machines feature a traditional economizer circuit that taps refrigerant upstream of the compressor and re-enter it in a section located between the compressor discharge and the condensing member.

This brings the disadvantage of having a reduction of the mass flow rate drawn by the compressor, due to the evaporation temperature decrease due to the action of the economizer which increases the enthalpy gap at the evaporator, which entails an increase in the temperature of the gas to the compressor discharge, being the energy transferred to the fluid by the compression work absorbed by a refrigerant reduced amount.

The underlying problem of the present invention is to propose an actuation method of a refrigerating machine provided with an economizer apparatus which increases the energy yield of the refrigerating machine in comparison to the traditional refrigerating machines.

The main task of the present invention consists in carrying out an actuation method of a refrigerating machine provided with an economizer apparatus which solves such problem solving the complained drawbacks of the traditional refrigerating machines.

Within such task it is the aim of the present invention to propose an actuation method of a refrigerating machine provided with an economizer apparatus which allows to increase the yield of the refrigerating machine when it works at condensing temperatures that overcome the safety temperature predefined for the traditional refrigerating machines.

A further aim of the invention is to propose an actuation method of a refrigerating machine which allows to increase the lifetime and/or the efficiency time in comparison to the traditional refrigerating machines and which, in particular allows to increase the lifetime and/or the efficiency time of the compressors thereof.

This task, as well as these and other aims which will appear better hereinafter are reached by an actuation method of a refrigerating machine provided with an economizer apparatus according to the enclosed independent claim which reference is here integrally made.

Detailed features of the actuation method of a refrigerating machine provided with an economizer apparatus according to the invention, are reported in the dependent claims which reference is here made.

In practice, the adoption of an actuation method of a refrigerating machine provided with an economizer apparatus according to the invention allows to reach the advantage of extending the activity field of the economizer apparatus beyond the safety temperature threshold predefined for the traditional machines. Furthermore, it allows to increase life and efficiency of the compressor and of the economizer itself, reducing also the maintenance required for keeping the refrigerant machine efficiency, in particular thanks to the fact of avoiding activation and deactivation cycles which are carried out by traditional refrigerating machines in operating conditions at condensing temperature at the safety temperature value.

Further features and advantages of the invention will result much more from the description of a preferred, but not exclusive, embodiment of an actuation method of a refrigerant machine provided with an economizer apparatus according to the invention, illustrated as an indication and not a limitation in the enclosed sheets of drawings, in which.

Figure 1:
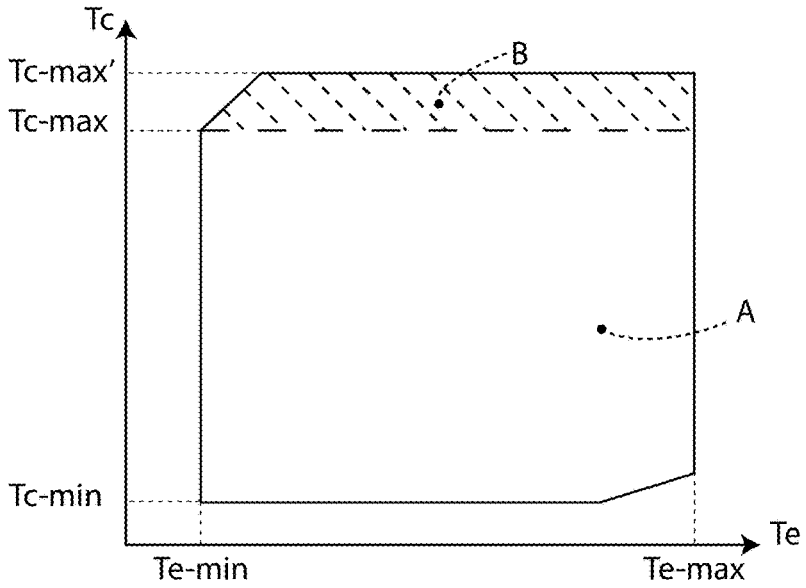
FIG. 1 illustrates a simplified diagram which shows the comparison between the range of the admissible operating conditions of a traditional refrigerating machine (continuous line) and of a refrigerating machine according to the invention (dotted line)
Figure 2:
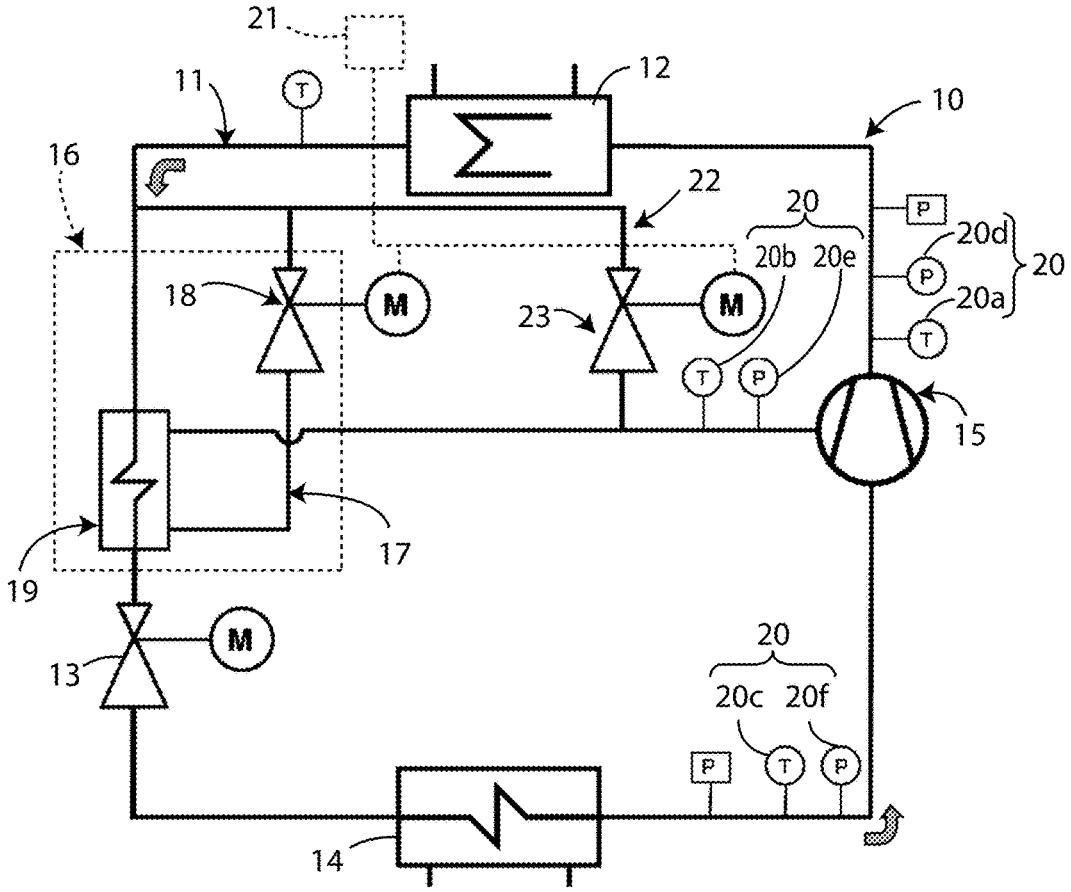
FIG. 2 illustrates a simplified scheme of a refrigerant machine according to the invention.

With particular reference to the cited figures, it is overall indicated by 10 a refrigerating machine which includes a circuit 11 for a refrigerating fluid and, linked along the circuit 11, includes:

- a condensing member 12;
- a main laminating member 13;
- an evaporation member 14;
- a screw compressor 15.

The refrigerating machine 10 includes also an economizer apparatus 16 which in turn includes:

- a duct 17 for the refrigerating fluid, coupleable to the circuit 11, downstream of the condensing member 12 and at the compressor 15;
- an auxiliary laminating member 18, connected to duct 17 for laminating the refrigerating fluid which, in use, flows inside it;
- a heat exchanger 19 connected to duct 17 downstream of the auxiliary laminating member 18 and coupleable to circuit 11 for exchanging heat between the fluid flowing in duct 17 and the fluid flowing in circuit 11.

Advantageously, the duct 17 is coupled to the circuit 11 upstream to said heat exchanger 19, to tap refrigeration fluid.

Moreover, the duct 17 has a discharge section connected to an intermediate section of the compressor 15 so as to inject the tapped fluid therein.

Furthermore, the refrigerating machine 10 includes associable monitoring means, overall indicated by reference 20 in the enclosed figures, designed for detecting operating thermodynamic parameters of the refrigerating machine 10 and for supplying a signal which is a function of the value of said thermodynamic parameters.

According to the present invention, the refrigerating machine 10 presents a particular characteristic in including a control device 21 which is connected to the monitoring means 20 and to the auxiliary laminating member 18 and is designed to modulate the opening of the auxiliary laminating member 18 according to two operational criteria:

- according to a first criterion, when the condensing temperature detected by the monitoring means 20 is lower than or equal to a first threshold value Tc-max, according to such first criterion the opening of the auxiliary laminating member 18 is actuated depending on the overheating of the tapping flow rate at the compressor entrance, in a per se traditional way;
- according to a second operative criterion, when instead the condensing temperature is higher than the first threshold value Tc-max, according to such second criterion the opening of the auxiliary laminating member 18 is actuated depending on the relative value of the condensing temperature in comparison with the first threshold value Tc-max or with a second predefined threshold value Tc-max' which is higher than Tc-max.

In other words, the control device 21 according to the invention modulates the opening of the auxiliary laminating member 18 between a condition in which it is completely closed, if the condensing temperature is equal to the second threshold value Tc-max', and a condition of opening in which the opening degree is defined:

- depending on the difference between the condensing temperature and the first temperature of threshold Tcmax, if the condensing temperature is higher than or equal to the first temperature of threshold Tc-max, or in order to maintain equal to a predefined value the overheating value of the tapping flow rate at the entrance of the compressor 15, if the condensing temperature is lower than the first temperature of threshold Tc-max.

In practice, the control device 21 preferably is a programmable electronic device and the auxiliary laminating member 18 advantageously is a motorized valve which can be electronically controlled by a stepper motor.

The monitoring means 20 preferably include at least a first pressure sensor 20*d* connectible at the compression member 15 delivery or at a circuit segment for the refrigerating fluid exiting from the compression member 15 itself.

Advantageously, the above mentioned condensing temperature is the saturation temperature corresponding to the pressure detected by the first pressure sensor 20*d*.

In general, the first pressure sensor 20*d* is advantageously connected to the compressor of a refrigerating machine and/or at the circuit of the refrigerating machine itself, or downstream of the compressor of the latter.

The monitoring means 20 advantageously include pressure sensors 20*e* and 20*f* connectable to the circuit of a refrigerating machine and/or to the duct 17, or to the compressor 15 of the refrigerating machine itself, for monitoring, in use, pressure of the refrigerating fluid entering the compressor 15.

Preferably, the monitoring means 20 include second temperature sensors 20*a*, 20*b* and 20*c* connectable to the circuit 11 or to the duct 17, upstream of the compressor 15, or at the compression member itself, for monitoring temperature of the refrigerating fluid entering and exiting the compressor.

In particular, the temperature sensor 20*b* and the pressure sensor 20*e* are intended to detect respectively the temperature of the overheated vapour and the pressure of the tapping flow rate inserted in the compressor 15 of the economizer apparatus 16.

According to a preferred, but not exclusive, form of the present invention, to which FIG. 1 is referred, the condensing temperature is indicated by the reference Tc; the first threshold value is indicated by Tc-max and the second threshold value is indicated by Tc-max'.

Just for example, which is not limitative, the first threshold value may be included between 58° C. and 62° C., and it may preferably be equal to 60° C.; the second threshold value may advantageously be included between 64° C. and 66° C. and it may preferably be equal to 65° C.

Advantageously, the control device 21 described in the present description operates the auxiliary laminating member 18 according to a per se known control method and deriving, mutatis mutandis, from that described in the European Patent in the name of Carel Industries Srl, filed on Jan. 12, 2005 and published on 9 Jun. 2010 under number EP2094344 which is integrated herein as reference.

According to the above mentioned European Patent, the control device 21, when Tc<Tc-max, advantageously adjusts the opening of the auxiliary laminating member 18 in order to keep a predefined overheating value of the tapping flow rate entering the compression member 15, i.e. the opening of the auxiliary laminating member 18 provides to follow the overheating set-point of the refrigerating gaseous fluid exiting the heat exchanger 19 and directed to the compression member 15.

Advantageously, the refrigerating machine 10 includes also a bypass branch 22 provided with a laminating valve 23 adapted to bypass the economizer apparatus 16 and to introduce in the compressor 15 a fraction of the tapping flow rate.

The control device 21 is connected to a laminating valve 23 of the bypass branch and designed for operating it in order to limit the overheating temperature at the entrance of the compressor 15.

Advantageously, the control device 21 is also connected to the main laminating member 13 for operating it in a coordinated manner with the auxiliary laminating member 18 and the laminating valve 23.

It is an object of the present invention an actuation method of a refrigerating machine 10 provided with a economizer apparatus 16 and including an auxiliary laminating member 18 having the opening adjustable for modulating a tapping flow rate of refrigerating fluid flowing through the economizer apparatus 16.

The refrigerating machine 10 is further provided with a screw compressor 15.

This actuation method 10, in a per se traditional manner includes:

a checking phase of the value of the condensing temperature Tc compared with a first threshold value Tc-max;

a first adjustment phase of the opening of the auxiliary laminating member 18 in order to substantially keep the temperature of said tapping flow rate at the entrance of the compressor 15 of the refrigerating machine 10 equal to a predetermined overheating value, if the condensing temperature Tc is lower than the first threshold value Tc-max.

Preferably said first adjustment phase is carried out by an adjustment method of the type described in the above mentioned European Patent n. EP2094344.

In other words, the actuation method 10 provides to modulate the opening of the auxiliary laminating member 18 in order to keep the temperature of the tapping flow rate at the entrance of the compressor 15 equal to a predefined overheating value until the condensing temperature Tc is lower than the first threshold value Tc-max.

According to the present invention, the actuation method 10 presents a particular characteristic in including a second adjustment phase of the opening of the auxiliary laminating member 18 depending on the value of the condensing temperature Tc if the latter is equal to or higher than the first threshold value Tc-max, being provided the injection of the tapping flow rate in an intermediate section of the compressor 15.

Thanks to such second adjustment phase, the adjustment method 10, according to the invention, allows to keep operative the economizer apparatus also for temperatures higher than the first threshold value Tc-max, at which, in the traditional refrigerating machines, the economizer apparatus is deactivated, i.e. the auxiliary laminating member is closed.

Preferably, said second adjustment phase provides that said auxiliary laminating member 18 is closed if the condensing temperature Tc is equal to a second predefined threshold value Tc-max', higher than the first threshold value Tc-max.

Said second adjustment phase advantageously provides that the opening of the auxiliary laminating member 18 varies according to a predefined law between:

a maximum value, assumed when the condensing temperature Tc is equal to the first threshold value Tc-max;

a null value, corresponding to the closure of the auxiliary laminating member 18, when the condensing temperature Tc is equal to the second threshold value Tc-max'.

Said predefined law preferably is a law of linear variation of the opening, from the maximum value to the null value, depending on the condensing temperature Tc.

Said maximum value of the opening advantageously is the opening value defined in said first adjustment phase when the condensing temperature Tc reaches the first threshold value Tc-max.

In other words, said maximum value is the opening value of the auxiliary laminating member 18 imposed in said first adjustment phase when the condensing temperature Tc reaches the first threshold value Tc-max.

The first threshold of temperature Tc-max and the second threshold of temperature Tc-max' are defined in a traditional way depending on the power of the driving motor of the compressor 15.

In particular it is to be kept in mind that the power of the compressor 15 of a refrigerating machine 10 is chosen depending on the refrigerating power to be supplied and it is therefore a fixed value for each refrigerating machine 10.

The maximum condensing temperature obtainable by a given compressor 15 decreases at the increase of the mass flow rate elaborated by the compressor 15.

When in a refrigerating machine the economizer apparatus is operative, the mass flow rate elaborated by the compressor is higher than that elaborated when, on other equal terms, the economizer apparatus is not operative.

By predefined values of power of the compressor motor and values of evaporation temperature of the refrigerating machine (i.e. of the temperature at the evaporation member) the maximum condensing temperature at which a compressor can work decreases at the increase of the mass flow rate.

In practice, therefore, the first threshold value Tc-max is equal to the value of the maximum condensing temperature at which the compressor is able to work when the mass flow rate is that given when the economizer is operative.

Similarly, the second threshold value Tc-max' is equal to the value of the maximum condensing temperature at which the compressor is able to work when the mass flow rate is that given when the economizer is not operative, that is lower than that when the economizer is operative.

Therefore, the threshold values Tc-max and Tc-max' are predefined by the compressor manufacturer and they depend on the motor power of the compressor itself and on the evaporation temperature of the refrigerating machine. In practice, by carrying out the adjustment method according to the invention, the mass flow rate elaborated by the compressor is modulated when the condensing temperature Tc varies, between the first threshold value Tc-max and the second threshold value Tc-max', so that the condensing temperature between such threshold values is equal to the maximum condensing temperature at which the compressor can work due to the power of its motor and to the evaporation temperature of the refrigerating machine. Preferably, the actuation method 10 includes also a lowering phase of the overheating temperature of said tapping flow rate at the entrance of the compressor 15, by injection of a bypass flow rate of refrigerating fluid, tapped downstream of the condensing member of the refrigerating machine.

Said lowering phase of the overheating temperature is carried out per se also in some traditional refrigerating machines and not further described.

Advantageously, said lowering phase of the temperature is carried out if a delivery temperature, equal to the temperature of the refrigerating fluid at the delivery of compressor 15, is equal to or higher than a safety value, the bypass flow rate being modulated in order to keep said delivery temperature lower than or equal to said safety value.

Figure 3:
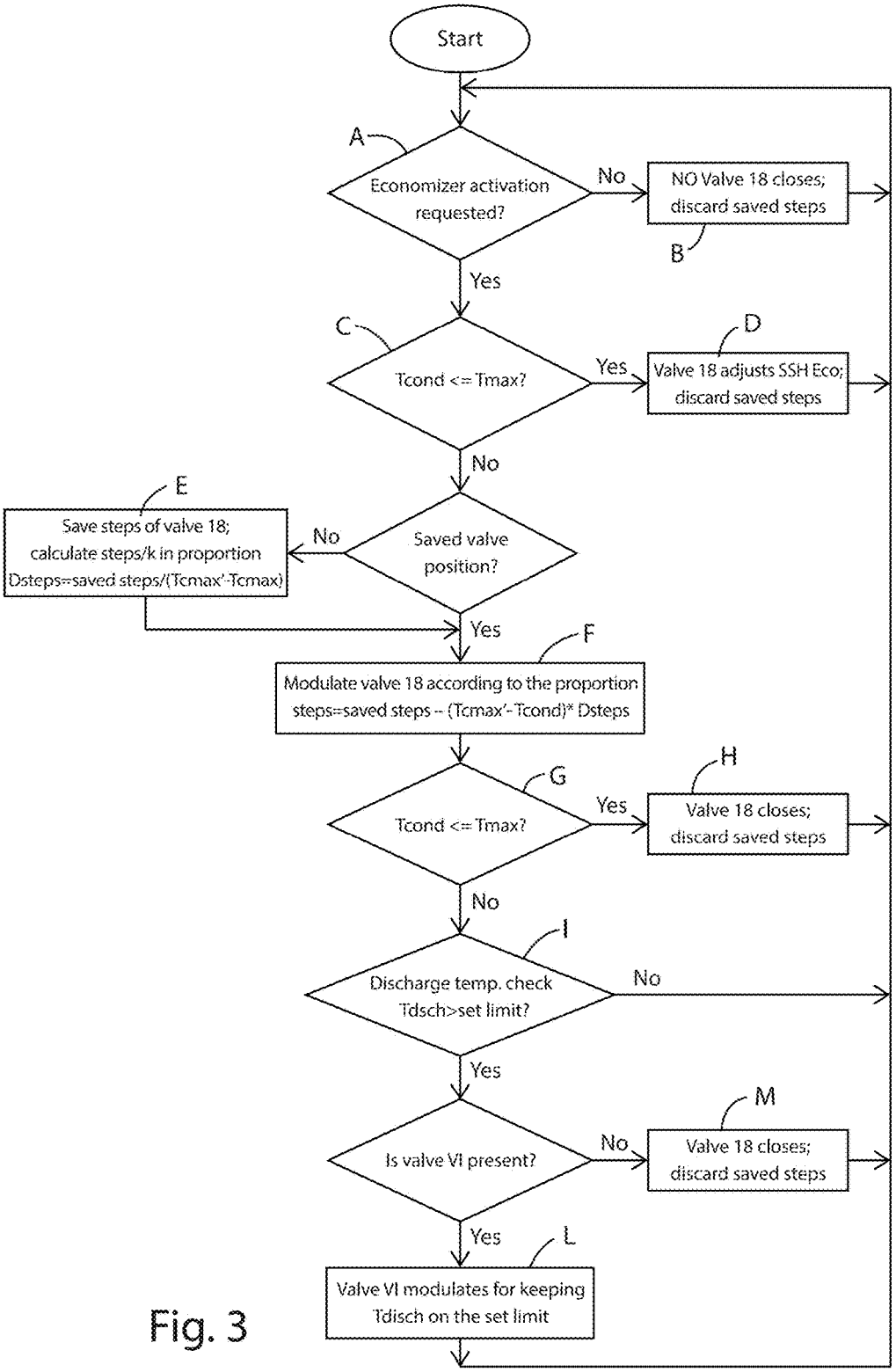
FIG. 3 illustrates an exemplifying flowchart of the actuation method according to the invention.

In FIG. 3 it is illustrated, just for not limitative example, an example of realization of an actuation method, according to the present invention, of a refrigerating machine provided with an auxiliary laminating member operated by a stepper motor and with a device monitoring the steps of such motor.

In accordance with said example of realization the actuation method provides to check (A) if the economizer activation is required and, if such activation is not required, to discard the saved motor steps (B).

If the economizer activation is required and it happens (C) that the condensing temperature Tc is lower than or equal to the first threshold value Tc-max, then the save motor steps are discarded and the auxiliary laminating member 16 is operated according to the per se known first adjustment phase (D).

If the economizer activation is required, and the condensing temperature Tc is higher than the first threshold value Tc-max, then the current number of the steps of the motor np is stored and it is calculated the number of steps for the closure Dsteps according to the formula Dsteps=np/(Tc-max'−Tcmax) (E).

Therefore the opening of the auxiliary laminating member 16 is modulated (F) putting the motor at a number of steps p given by the formula p=np−(Tc-max'−Tc)Dsteps.

It is verified (G) if the condensing temperature Tc is higher than the second threshold value Tc-max', in positive case the auxiliary laminating member 16 is closed (H) and the motor steps are discarded.

It is verified (I) if the discharging temperature Tsc of the compressor 15 is higher than a safety value Vs.

In positive case, if the refrigerating machine 10 includes a laminating valve 23, then the opening of the laminating valve 23 is modulated (L) in order to keep the discharging temperature Tsc approximately equal to the safety value Vs, otherwise steps np of the motor are discarded and the auxiliary laminating member 18 is closed (M).

It is clear that the method according to the present invention may provide the use of any actuation method in replacement of the stepper motor of the example herein proposed and that the saving and discarding operations of steps np of such motor may be substituted respectively by a detecting operation of the opening degree of the auxiliary laminating member 18 and by a discarding operation of such opening degree. In general, by carrying out of the present invention, it is obtained the advantage of extending the range of functional conditions in which the economizer apparatus 16 is operative during the operation of the refrigerating machine 10 that includes it, in comparison with the range of functional conditions in which the economizer apparatus of a traditional refrigerating machine is operative.

In accordance with the example illustrated in FIG. 1, the range of the functional conditions of a traditional refrigerating machine is that defined by a dotted line and indicated by the reference A.

An advantage of the present invention is obtaining an extension of the field A in the region indicated by the reference B and by the background in dotted lines, in FIG. 1.

In a refrigerating machine which operates according to the method of the present invention, the economizer effect of injecting fluid in an intermediate section of the compressor, is to increase the refrigerant flow rate processed by the compressor.

In particular, the increase in the enthalpy gap at the evaporator leads to a decrease of the evaporation temperature or a decrease in the density of the gas sucked by the compressor.

However, in accordance with the present invention, the flow of fluid that passes through the economizer circuit is injected into an intermediate section of the compressor, this is equivalent to a increase in the density of the gas processed by the compressor.

In conventional machines, however, there is a reduction of the overall mass flow processed by the compressor due to the decrease in the density of the gas sucked by the compressor, not having the additional injection of refrigerant in the intermediate section which is instead provided in the refrigerating machine according to the invention.

In practice, a machine operating according to the method of the present invention is controlled so as to maintain active the economizer circuit over the threshold conditions, i.e. over the condensation temperature threshold, by decreasing the flow rate passing through the economizer while in conventional machines the control is performed controlling the compressor discharge temperature, which is determined by the fact of sucking gas at a lower density, while this aspect being overcome in a machine according to the present invention by the fact of injecting the fluid processed by the economizer at an intermediate section of the compressor.

In other words, in the machine according to the present invention, the limit to be controlled during operation is a mechanical limit, due to the fact that the power required by the compression work is higher, compared to traditional machines according to the increase of mass flow rate subsequent to the injection of the refrigerant fluid drawn downstream the evaporator, in an intermediate section of the compressor. Conventional machines, as described in the patent documents mentioned above, however have the disadvantage of having a reduction of the mass flow drawn by the compressor, by the action of the bypass due to the economizer circuit, which entails an increase in the temperature of the gas at the compressor discharge, being the energy transferred to the fluid by means of the compression work absorbed by a smaller amount of refrigerant.

In practice a refrigerating machine 10 that operates according to an actuation method according to the present invention, on equal operating terms, has a range of functional conditions which exceeds that of a traditional machine of the whole region B and, therefore, a refrigerating machine 10 according to the invention, according to the example in question, has a range of functional conditions in which the economizer apparatus is operative which is given by the sum of the field A and the region B.

In other words, the economizer apparatus 16, even if elaborating a flow of refrigerating fluid decreasing when Tc increases, between Tc-max and Tc-max', thus improving the performances of a refrigerating machine 10 compared to the traditional refrigerating machines.

The invention so conceived is susceptible of many changes and variations, each one being in the sphere of protection of the enclosed claims.

In particular, a refrigerating machine according to the invention will present better performances (higher COP and EER) compared to a traditional refrigerating machine. Furthermore a refrigerating machine according to the invention will result more long lasting and in particular will require less maintenance especially of the economizer apparatus and of the compressor.

Furthermore, all details may be substituted by other technically equivalent elements.

For example the screw compressor may be substituted by an equivalent positive displacement compressor.

In practice, the materials employed, as well as the contingent shapes and sizes, may be changed depending on the contingent requirements and on the state of the art.

Where the structural features and the technics mentioned in the following claims are followed by reference signs or numbers, such reference signs or numbers have been affixed with the only aim of increasing the intelligibility of the claims themselves and, accordingly, they will not constitute in any way a limitation to the interpretation of each element identified, just for example, by such reference signs and numbers.

The invention claimed is:

1. An actuation method of a refrigerating machine (10) provided with an economizer apparatus (16) and including an auxiliary laminating member (18) having an adjustable opening for modulating a tapping flow rate of refrigerating fluid flowing through said economizer apparatus (16) when said economizer apparatus (16) is active, said refrigerating machine (10) being provided with a control means (21) a screw compressor (15), said actuation method including:

a monitoring means (20) for checking the value of a condensing temperature (Tc) compared to a first threshold value (Tc-max);

said control means (21) being adapted to carry out a first adjustment phase for the opening of said auxiliary laminating member (18) in order to keep an overheating temperature of said tapping flow rate at the entrance of the screw compressor (15) of the refrigerating machine (10) substantially equal to a predetermined overheating value, said first adjustment phase being carried out when said economizer apparatus (16) is active and if the condensing temperature (Tc) is lower than or equal to said first threshold value (Tc-max); said control means (21) being adapted to carry out a second adjustment phase for the opening of said auxiliary laminating member (18) depending on the value of said condensing temperature (Tc) if the latter is higher than said first threshold value (Tc-max); said method providing for the injection of said tapping flow rate in an intermediate section of said screw compressor (15) by a discharge section of duct (17), wherein said second adjustment phase provides that said auxiliary laminating member (18) is closed if the condensing temperature (Tc) is equal to a second predefined threshold value (Tc-max'), higher than said first threshold value (Tc-max), and that said economizer apparatus (16) is active if the condensing temperature (Tc) is comprised between the first (Tc-max) and said second predefined threshold value (Tc-max).

2. An actuation method according to claim 1, wherein said second adjustment phase provides that the opening of said auxiliary laminating member (18) varies between: —a maximum value, that corresponds to said condensing temperature (Tc) when said condensing temperature (Tc) is equal to said first threshold value (Tc-max); —a null value, corresponding to the closure of said auxiliary laminating member (18), when said condensing temperature (Tc) is equal to said second threshold value (Tc-max'); wherein said opening of said auxiliary laminating member (18) depends on said condensing temperature (Tc).

3. An actuation method according to claim 2 wherein said maximum value is the opening value defined in said first adjustment phase when said condensing temperature (Tc) reaches said first threshold value (Tc-max).

4. An actuation method according to claim 3 including a lowering phase of said overheating temperature of said tapping flow rate at the entrance of the screw compressor (15) by injection of a bypass flow rate of refrigerating fluid, tapped downstream of a condensing member of said refrigerating machine.

5. An actuation method according to claim 2 including a lowering phase of said overheating temperature of said tapping flow rate at the entrance of the screw compressor (15) by injection of a bypass flow rate of refrigerating fluid, tapped downstream of a condensing member of said refrigerating machine.

6. An actuation method according to claim 1 wherein said control means (21) includes a lowering phase for said overheating temperature of said tapping flow rate at the entrance of the screw compressor (15) by injection of a bypass flow rate of refrigerating fluid, tapped downstream of the condensing member of said refrigerating machine.

7. An actuation method according to claim 6 wherein said lowering phase of said overheating temperature of said tapping flow rate at the entrance of said screw compressor (15) is carried out if a delivery temperature, equal to the temperature of the refrigerating fluid at the delivery of said screw compressor (15), is equal to or higher than a safety value, said bypass flow rate being modulated in order to keep said delivery temperature lower than or equal to said safety value.

8. An actuation method according to claim 1, including a lowering phase of said overheating temperature of said tapping flow rate at the entrance of the screw compressor (15) by injection of a bypass flow rate of refrigerating fluid, tapped downstream of a condensing member of said refrigerating machine.

9. A refrigerating machine includes a circuit (11) for a refrigerating fluid and, linked along the circuit (11), includes:

a condensing member (12);

a main laminating member (13);

an evaporation member (14);

a screw compressor (15);

wherein the refrigerating machine (10) includes an economizer apparatus (16) which in turn includes:

a duct (17) for the refrigerating fluid, coupleable to the circuit (11), downstream of the condensing member (12) and at the heat exchanger 19;

an auxiliary laminating member (18), having an adjustable opening for modulating a tapping flow rate of refrigerating fluid flowing through said economizer apparatus (16) when said economizer apparatus (16) is active, connected to duct (17) for laminating the refrigerating fluid which, when said economizer apparatus (16) is in use, flows inside said auxiliary laminating member (18);

a heat exchanger (19) connected to duct (17) downstream of the auxiliary laminating member 18 and coupleable to circuit (11) for exchanging heat between refrigerating fluid flowing in duct (17) and refrigerating fluid flowing in circuit (11);

wherein the duct (17) is coupled to the circuit (11) upstream of said heat exchanger (19), to tap refrigeration fluid;

wherein the duct (17) has a discharge section connected to an intermediate section of the compressor (15) so as to inject the tapped fluid therein; wherein the refrigerating machine (10) includes monitoring means designed for detecting operating thermodynamic parameters of the refrigerating machine (10) and for supplying a signal which is a function of the value of said thermodynamic parameters; wherein the refrigerating machine (10) includes a control means (21) which is connected to the monitoring means and to the auxiliary laminating member (18) wherein said control means (21) is designed to modulate the opening of the auxiliary laminating member (18) according to two operational criteria;

according to a first criterion, when the condensing temperature detected by the monitoring means (20) is lower than or equal to a first threshold value Tc-max, according to such first criterion the opening of the auxiliary laminating member (18) is actuated by the control means (21) depending on the overheating of the tapping flow rate at the compressor entrance; —according to a second operative criterion, when instead the condensing temperature is higher than the first threshold value Tc-max, according to such second criterion the opening of the auxiliary laminating member (18) is actuated by the control means (21) depending on the relative value of the condensing temperature in comparison with the first threshold value Tc-max or with a second predefined threshold value Tc-max' which is higher than the first threshold value Tc-max.

* * * * *